US008192329B2

(12) United States Patent
Saitou et al.

(10) Patent No.: US 8,192,329 B2
(45) Date of Patent: Jun. 5, 2012

(54) EXERCISE AIDING APPARATUS

(75) Inventors: Atsuhiro Saitou, Hirakata (JP); Fumihiro Nishio, Hikone (JP); Takahisa Ozawa, Katano (JP); Takao Gotou, Hirakata (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/934,104

(22) PCT Filed: Mar. 31, 2008

(86) PCT No.: PCT/JP2008/056435

§ 371 (c)(1),
(2), (4) Date: Sep. 23, 2010

(87) PCT Pub. No.: WO2009/122552

PCT Pub. Date: Oct. 8, 2009

(65) Prior Publication Data

US 2011/0021316 A1 Jan. 27, 2011

(51) Int. Cl.
*A63B 71/00* (2006.01)

(52) U.S. Cl. ..... 482/4; 482/52; 482/8; 482/51

(58) Field of Classification Search ..... 482/1–9, 482/51–53, 900–902
See application file for complete search history.

(56) References Cited

U.S. PATENT DOCUMENTS

| | | | | |
|---|---|---|---|---|
| 5,454,770 | A * | 10/1995 | Stevens | 482/52 |
| 2005/0209060 | A1 * | 9/2005 | Lull | 482/54 |
| 2006/0172862 | A1 | 8/2006 | Badarneh et al. | |
| 2010/0145233 | A1 * | 6/2010 | Zhang et al. | 600/592 |

FOREIGN PATENT DOCUMENTS

| | | | |
|---|---|---|---|
| JP | 3-101925 | U | 10/1991 |
| JP | 10-55131 | A | 2/1998 |
| JP | 11-244539 | A | 9/1999 |
| JP | 2002-306629 | A | 10/2002 |
| JP | 2006-526456 | A | 11/2006 |
| JP | 2008-23258 | A | 2/2008 |

OTHER PUBLICATIONS

International Search Report for the Application No. PCT/JP2008/056435 mailed May 1, 2008.

* cited by examiner

*Primary Examiner* — Glenn Richman
(74) *Attorney, Agent, or Firm* — Cheng Law Group, PLLC

(57) ABSTRACT

Exercise aiding apparatus includes a step 2 that a user puts a user's foot on, and a step drive means 5 that causes the step to perform movement including turning motion so that exercise is performed with respect to the foot put on the step. The apparatus includes a lock means 6 that fixes the step by engagement with the step except when the step drive means 5 drives the step. When the step is not driven, the step is fixed. The step is prevented from moving inadvertently at getting on and off, thereby ensuring safe getting on and off.

3 Claims, 7 Drawing Sheets

EXERCISE AIDING APPARATUS

TECHNICAL FIELD

The invention relates to exercise aiding apparatus for providing leg exercise for a user and, more particularly, to exercise aiding apparatus for providing passive exercise for users' legs.

BACKGROUND ART

Different pieces of exercise aiding apparatus have been proposed wherein a user's muscle group is stretched and contracted by not the user's own exertion of muscle strength but external force exerted to the user's body, and thereby effect of passive exercise is obtained. For example, a patent document 1 (Japanese Patent Application Publication No. 10-55131) has proposed apparatus for user's legs, which is used in standing position and simulates walking motion with the aim of knee osteoarthritis prevention or walking training.

The walking simulation apparatus of the patent document 1 is configured to horizontally drive right and left steps on which a user can put the user's feet and also to turn the steps in a front-back direction in order to change height position of the user's feet or inclination angles of the user's soles. The apparatus can further turn the steps in clockwise and counterclockwise directions in order to change directions of the user's feet.

In apparatus of which steps are turned, a user puts the user's feet on the steps to stand and then performs exercise, but when the user gets on and off the steps, the steps may move unnecessarily. Accordingly, a user may break down the balance to have a fall.

DISCLOSURE OF THE INVENTION

The present invention is provided in view of these respects described above, and an object is to provide exercise aiding apparatus enable a user to safely get on and off steps by preventing the steps from moving unnecessarily when getting on and off the steps.

The present invention is characterized by comprising: a step that a user puts a user's foot on; a step drive means configured to cause the step to perform movement including turning motion so that exercise is performed with respect to the foot put on the step; and a lock means configured to fix the step by engagement with the step except when the step drive means drives the step.

Preferably, the invention comprises a sensor configured to detect whether or not the foot is put on the step, and the lock means does not unlock the step when the sensor does not detect the foot.

Preferably, the lock means fixes the step to keep the top face of the step horizontal.

EFFECT OF THE INVENTION

In the exercise aiding apparatus according to the invention of claim 1, when the step is not driven, the step is always locked by the lock means. Accordingly, inadvertent movement of the step is avoided when getting on and off the step, and safe getting on and off is ensured.

In the exercise aiding apparatus according to the invention of claim 2, if the foot is not put on the step, the step is not unlocked. Accordingly, safe use can be secured.

In the exercise aiding apparatus according to the invention of claim 3, the step is fixed with the top face kept horizontal, and accordingly it is possible to more easily get on and off the step.

BRIEF DESCRIPTION OF THE DRAWINGS

FIG. 8 shows a sensor for detecting foot.

DESCRIPTION OF THE NUMERALS

Figure 1:
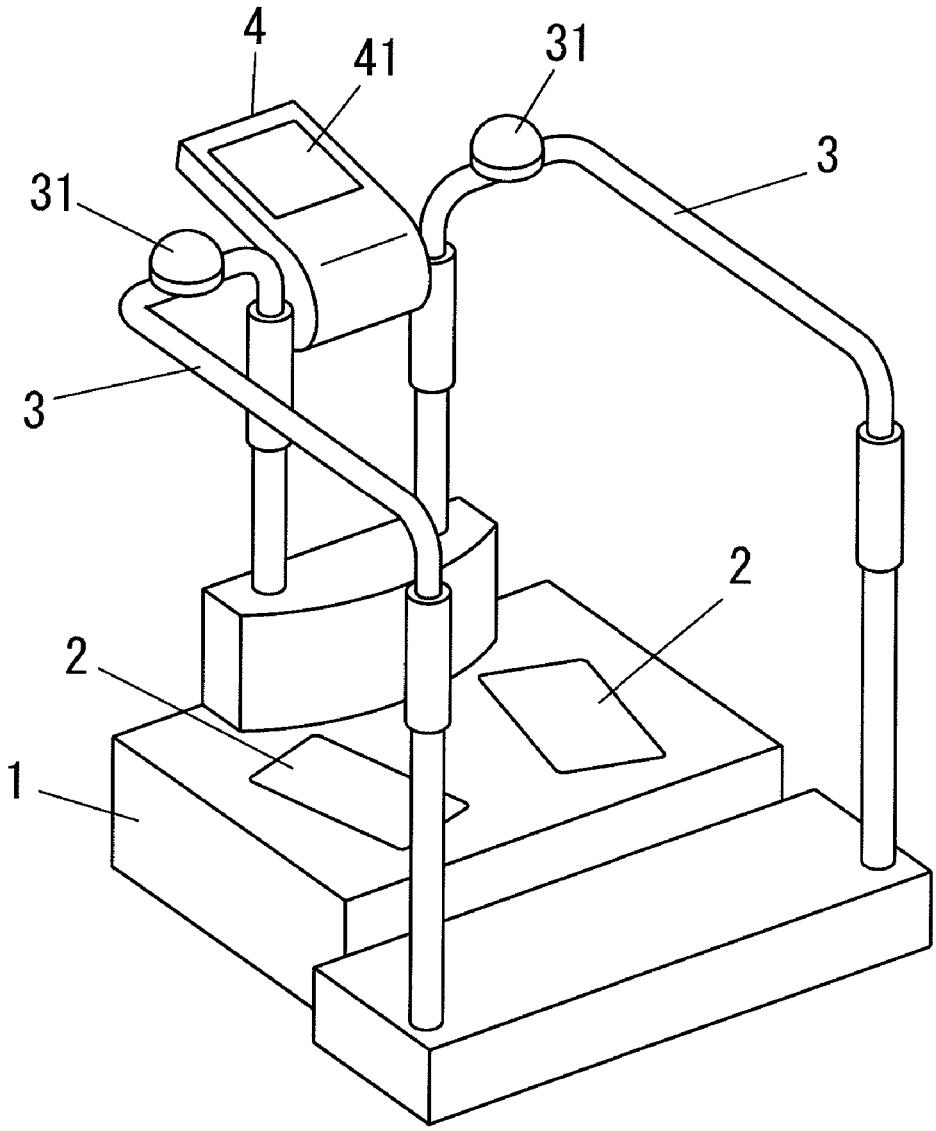
FIG. 1 is a perspective view of an appearance example in accordance with an embodiment of the invention.

1 base
2 step
3 handrail
4 operation panel
5 step drive means
6 lock means

BEST MODE FOR CARRYING OUT THE INVENTION

The present invention is explained based on embodiments in the accompanying drawings. The exercise aiding apparatus in the graphical example is formed of; a base 1 that right and left steps 2, 2 are put on the top face of the base 1; right and left handrails 3, 3 standing on the base 1; an operation panel 4 that is supported by the handrails 3, 3 and located at the front side of the base 1; and a step drive means 5 that is put in the base 1 and configured to drive the steps 2, 2. In the apparatus, a user grasps the right and left handrails 3, 3 and then puts the user's feet on the steps 2, 2 to stand. The apparatus then activates the step drive means 5 to move the steps 2, 2, thereby causing the user to perform passive exercise with respect to the user's legs.

Figure 2:
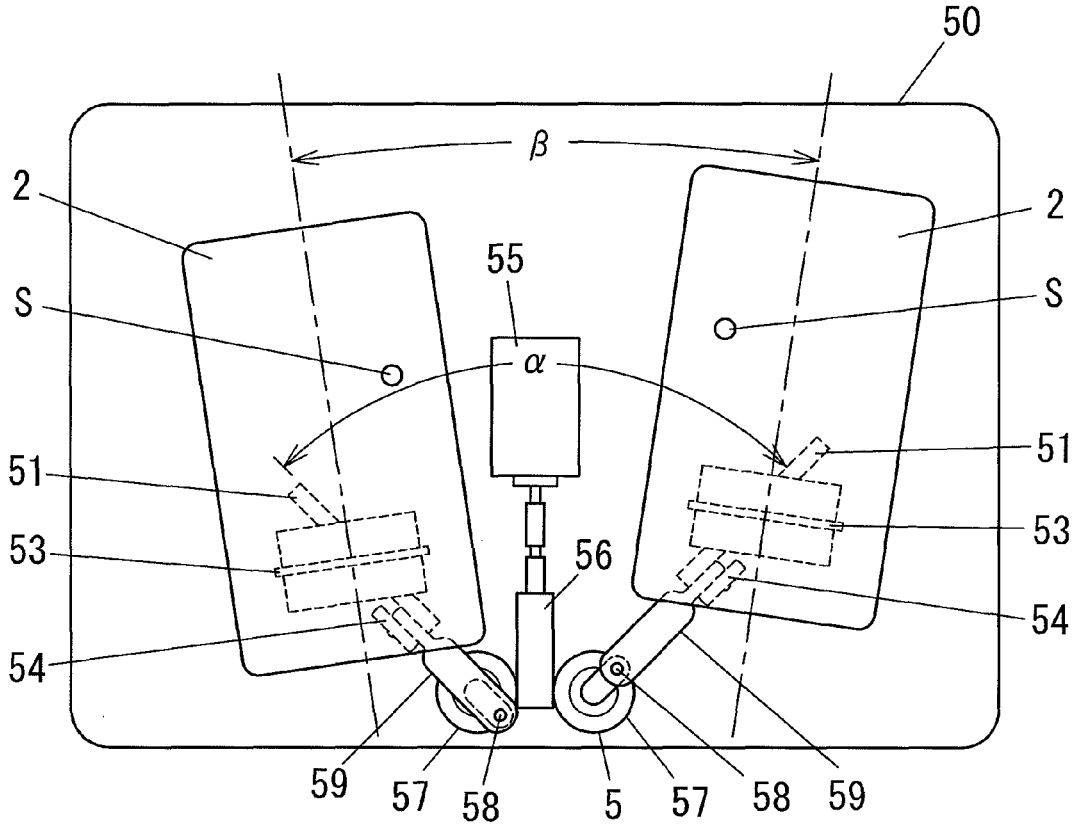
FIG. 2 is a perspective plane of steps and a step drive means in the embodiment.
Figure 3:
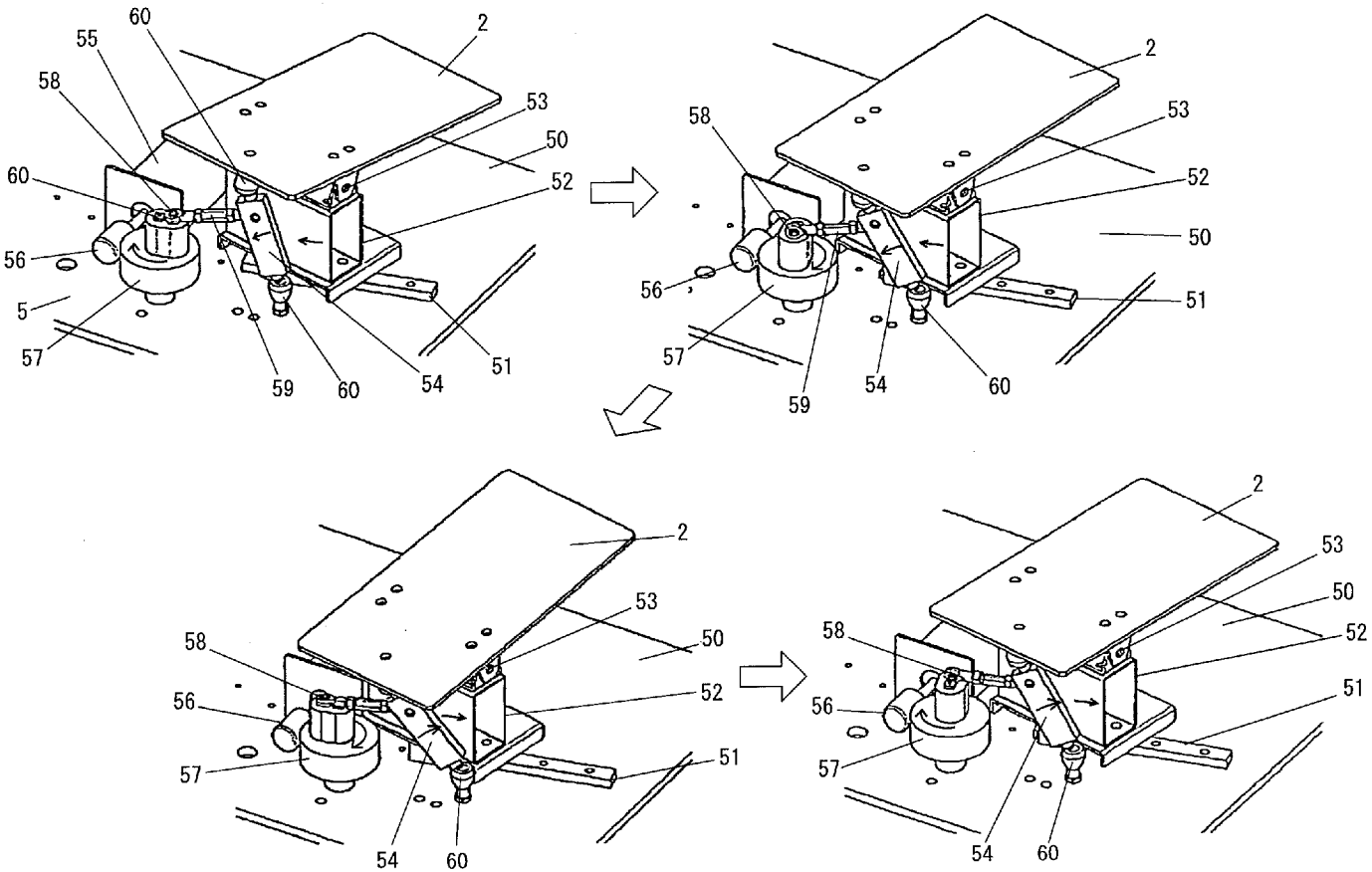
FIG. 3 is an explanatory diagram of operation of the step drive means.

Each of the steps 2, 2 has a dimension that a user's whole sole can be put on its own top face that includes material or shape for increasing a friction coefficient. Height position relation between anterior end side and posterior end side of each step 2 is changed in response to reciprocating slide operation in front-back and left-right directions through the step drive means 5. Thereby, plantarflexion operation for turning a toe side downward and dorsiflexion operation for turning a toe side upward are repeatedly performed with respect to the user's feet put on the steps 2. FIGS. 2 and 3 show the step drive means 5 for causing the steps 2, 2 to perform the motion.

The step drive means 5 shown herein is configured to change height position relation between each step's anterior end side and posterior end side and also to slide each step 2 in front-back and left-right directions. Guide rails 51, 51 are fixed on both sides of the top face of a base plate 50 (or a bottom plate of the base 1), respectively. Each guide rail 51 is fitted with a slide block 52 on the bottom of which a slider slidable along the guide rail 51 is provided. A rotation axis 53 is located at an upper side of each slide block 52. By the rotation axis 53, a step 2 in the shape of a plate is supported so that it can be turned around the rotation axis 53. Each one end side (posterior end) of the steps 2, 2 is combined with the base plate 50 through a link 54. Flexible joints 60, 60 are located at a joining section of one end of the link 54 and the base plate 50 as well as a joining section of the other end of the link 54 and a step 2, respectively.

A motor 55 for drive is placed, between the right and left slide blocks 52, 52, on the base plate 50. A worm 56 is attached to an output axis of the motor. A pair of worm wheels 57, 57 is located at both sides of the worm 56. The worm wheels 57, 57 have eccentric shafts 58, 58, respectively and engage with the worm 56. The eccentric shafts 58 are each connected with links 54 through connecting rods 59. A worm wheel 57 having an eccentric shaft 58 and the link 54 are spaced in the length direction of the guide rail 51. Both of them are connected by a connecting rod 59. Flexible joints 60, 60 are also located at the joining section of one end of the connecting rod 59 and the eccentric shaft 58 as well as the joining section of the other end of the connecting rod 59 and the link 54.

When the motor 55 rotates the eccentric shafts 58 through the worm 56 and the worm wheels 57, the connecting rods 59 oscillate the links 54 on the flexible joints 60 as central points of the base plate (50) side. Each eccentric shaft 58 and connecting rod 59 constitute a crank mechanism. The slide blocks 52, 52 and the steps 2 reciprocate and slide along the guide rails 51 by motion components, which coincide with the length directions of the guide rails 51, of the oscillating motion.

In the graphical example, the right and left guide rails 51, 51 are not parallel. They are located on the base plate 50 so that the interval between the guide rails 51, 51 of the anterior end side becomes wider than that of the posterior end side. The anterior end side corresponds to the side of the toes of feet put on the steps 2. Accordingly, the slide blocks 52 and the steps 2 fitted to the V-shaped guide rails 51, 51 move while spreading laterally when moving forward. Incidentally, in the graphical example, the open angle $\alpha$ of the V-shaped guide rails 51, 51 is 90-130°, but may be another angle.

Each joining section of a link 54 and a step 2 also moves in a vertical direction by oscillating motion of the link 54, while the step 2 is also turned around a rotation axis 53 as a central point. The link 54 and the eccentric shaft 58 is connected with a connecting rod 59 so that: the step 2 becomes horizontal if the sliding motion is in the middle of the stroke; the posterior end side of the step 2 connected to the link 54 is raised if at one end of the stroke; and the posterior end side of the step 2 is lowered if at the other end of the stroke.

Accordingly, the steps 2 slide along the guide rails 51, while at the same time the sides of the toes are lowered when moving forward and the sides of the heels are lowered when moving backward.

As seen from FIG. 2, the rotation axes 53 as the rotating central points of the steps 2 are each perpendicular to the length directions of the steps 2 and located at the sides of the posterior ends than the middles, in the length directions, of the steps 2. The directions of the rotation axes 53 are also located so that the sides of the anterior ends of the steps 2 (the sides of the toes) are directed inside the guide rails 51 without making the directions perpendicular to the length directions of the guide rails 51, respectively.

The interval between the sides of the anterior ends of the steps 2, 2 is wider than that of the sides of the posterior ends, and the open angle $\beta$ is in a range of 10-30°. Accordingly, a user can put the user's feet on the steps 2, 2 to stand with leg muscle groups loosed (in a relaxed state).

The eccentric shafts 58 of the worm wheels 57, 57 engaging with the worm 56 are unsymmetrically arranged so that the step drive means 5 drives the right and left steps 2, 2 and thereby the left step 2 moves backward when the right step 2 moves forward while the right step 2 moves backward when the left step 2 moves forward. That is, the steps are driven in opposite phase. By the worm wheels 57, 57 engaging with the worm 56, the motive energy is distributed to the right and left steps, and accordingly the steps 2, 2 are always moved in sync with each other.

In the aforementioned exercise aiding apparatus, when performing exercise, a user grasps the handrails 3 and put the user's feet on the steps 2, 2 to stand. If the user then turns on the operation switch in the operation panel 4 to activate the step drive means 5, the steps 2, 2 moves forward, backward, rightward and leftward in opposite phase, while each anterior end side of the steps 2 is lowered when moving forward and each posterior end side is lowered when moving backward.

Accordingly, the user's feet put on the steps 2, 2 are moved forward and backward as well as rightward and leftward in response to the movement of the steps 2, while the user's ankle joints are plantarflexed and dorsiflexed by the turning of the steps 2.

The right and left steps 2, 2 are moved forward, backward, rightward and leftward in phase difference of 180°, and accordingly a user standing on the steps 2, 2 has a few gravity center movement in a front-back direction. Therefore, even if the balancing function of a user declines, the user hardly breaks down the balance by movement of the steps 2. However, not limited to the aforementioned value, the phase difference of motion of the steps 2, 2 may be 0°.

The user can grasp the handrails 3 to perform passive exercise, and accordingly even if the user breaks down the balance, it is possible to prevent the user from having a fall. However, in the graphical example, in order to enhance safety when a user breaks down the balance, emergency stop switches 31 for operation stop of the step drive means 5 are each located at the handrails 3 so that the user can easily push an emergency stop switch 31 by hand that grasps a handrail 3 when any accident occurs.

When a user gets on and off the steps 2, the motor 55 is rotated by a load exerted on the steps 2 and then the steps 2 may move. In this instance, the user may have a fall.

Figure 4A:
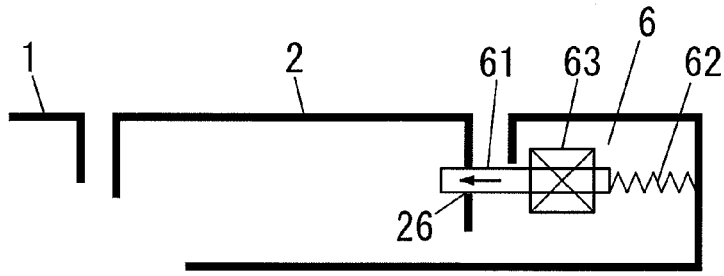
FIGS. 4*a* and 4*b* are sectional views showing an example of a lock means in the embodiment.
Figure 4B:
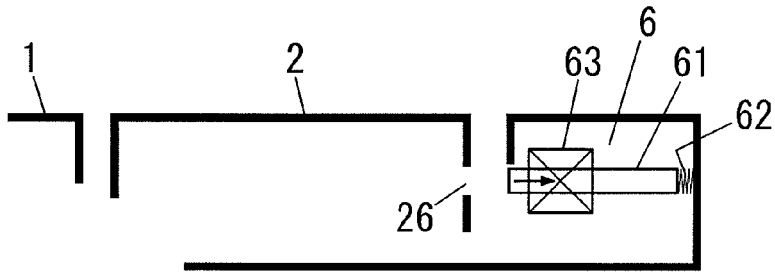

Accordingly, in the example, a lock means 6 for stopping the motion of a step 2 is provided. FIG. 4 shows an example where a solenoid 63 is used as a lock means 6. The solenoid 63 is put in the base 1 and includes a plunger 61 that is movable in the axis direction, and a spring 62 for biasing the plunger 61. When the solenoid 63 is unenergized, the plunger 61 is biased by the spring 62 to stick out and then inserted into an engagement hole 26 formed at the edge of the step 2. Thereby, the step 2 is locked so that it does not move.

When the solenoid 63 is energized and excited, the plunger 61 moves backward in the teeth of the spring 62 and then exits from the engagement hole 26. Thereby, the lock is released and the step 2 can be moved by the step drive means 5 as stated above.

Figure 5A:
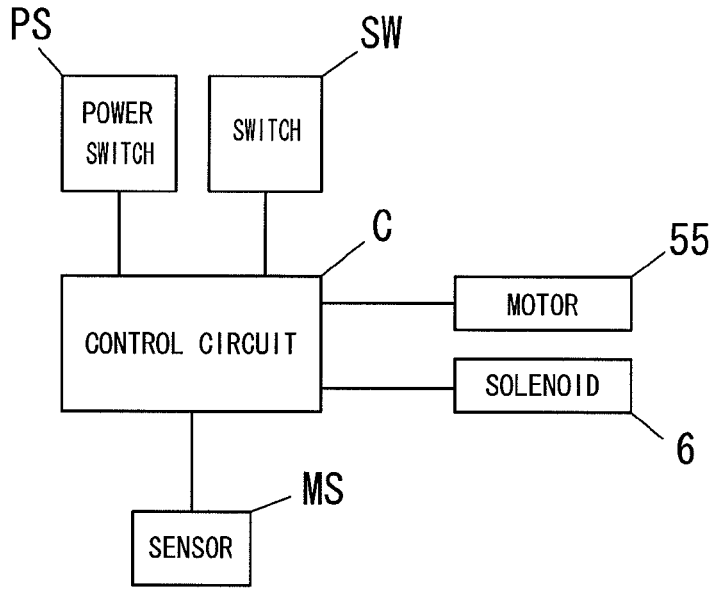
FIG. 5*a* is a block diagram of the embodiment and FIG. 5*b* is an explanatory diagram of the operation flow.
Figure 5B:
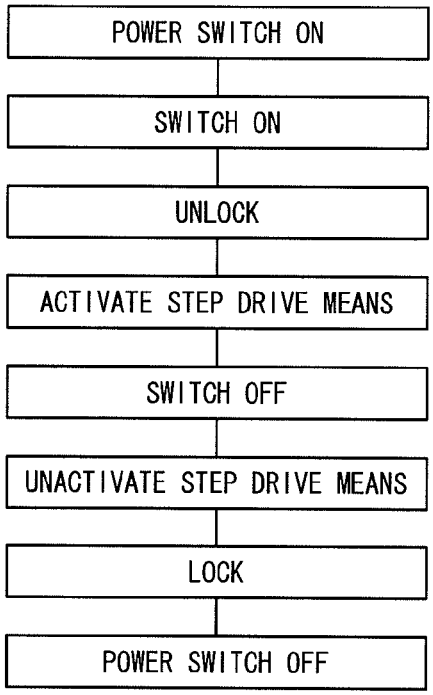

FIG. 5 shows a block diagram and a operation flow of the solenoid 63 as the lock means 6. When a power switch PS is turned on and a switch SW for activating the step drive means 2 is further turned on, a control circuit C for controlling the operation of the step drive means 5 and the lock means 6 excites the solenoid 63 to release the lock and then activates the step drive means 5. The circuit also locks the step 2 through the lock means 6 when inactivating the step drive means 2. The step 2 is always locked except when the step drive means 5 drives the step 2.

In the figure, the sensor MS is used to stop the step 2 at the position that the engagement hole 26 of the step 2 faces the lock means 6 when the step drive means 5 is stopped from driving the step 2. For example, it may be a sensor that detects whether or not the engagement hole 26 of the step 2 is at a predetermined position, a sensor that detects rotation position of the motor 55 in the step drive means 5, or the like.

Figure 6A:
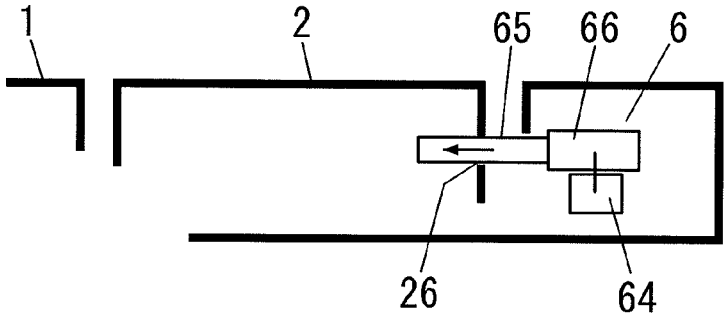
FIGS. 6*a* and 6*b* are sectional views showing an example of the lock means.
Figure 6B:
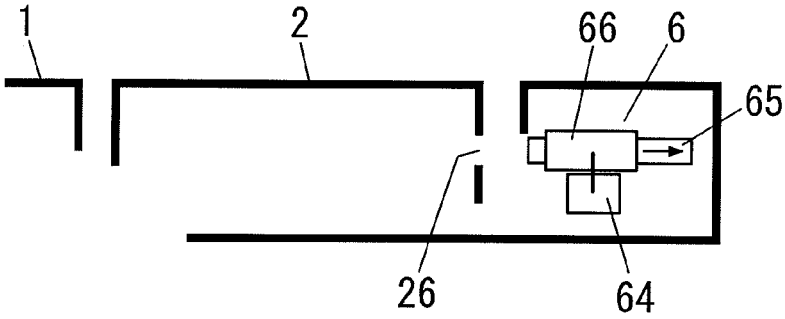

The solenoid 63 may be replaced with a means shown in FIG. 6 where a lock pin 65 is taken out and put in the engagement hole 26 by rotation of a forward/reverse rotatable motor 64 and thereby locking and unlocking may be performed. In the figure, 66 is a gear for converting a rotational movement of the motor 64 into a linear movement of the lock pin 65. In this instance, the motor 64 is controlled so that the step 2 is always locked except when the step drive means 5 drives the step 2.

When locking and unlocking are performed by the rotation of the motor 64, it is preferable that a sensor for detecting whether it is in locked state or unlocked state. For example, the sensor may be a sensor that detects the rotation position of the motor 64, a sensor that detects whether or not the lock pin 65 sticks out, or the like.

Figure 7:
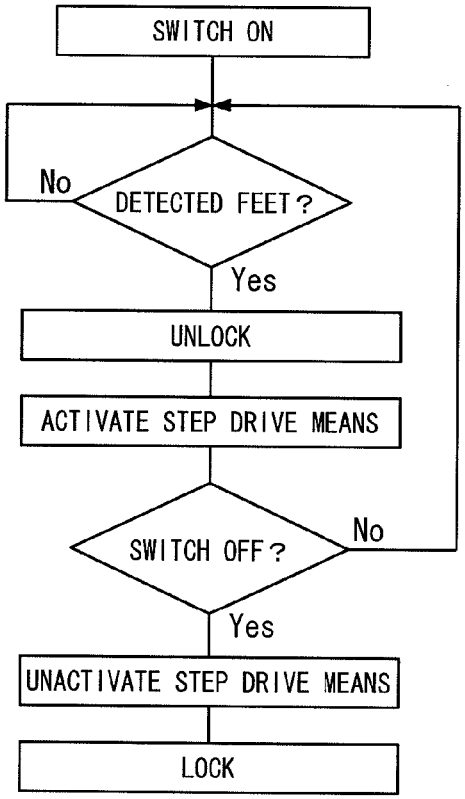
FIG. 7 is an explanatory diagram of another operation flow.

In any of the embodiments, it is preferable that the step 2 is locked so that the top face of the step 2 is kept horizontal. In this instance, a user can easily get on and of the steps 2. As shown in FIG. 2, a sensor S for detecting whether or not user's feet are put on the steps 2 is provided. Preferably, when the switch SW is turned on, if the sensors S, S located on the steps 2 detect user's feet, the steps 2 are unlocked and the step drive means 5 is activated and thereby the steps 2 are driven. In this instance, when the feet are not properly put on the steps 2, unlocking and activation are not performed. Accordingly, safety is secured. FIG. 7 shows the operation flow.

Preferably, when any one of the sensors S, S goes into not detecting a user's foot, even if stop operation is not performed through the switch SW, the step drive means 5 is stopped and the locked state is shifted to.

Figure 8A:
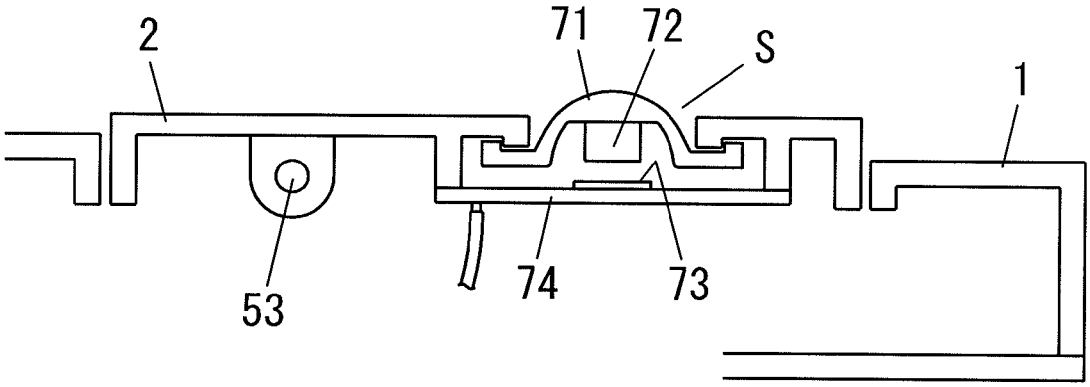
FIG. 8*a* is a sectional view and FIG. 8*b* is a plan view of a contact part.
Figure 8B:
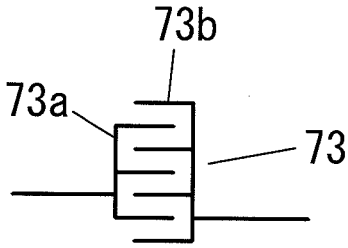

FIG. 8 shows a preferable example of the sensor(s) S. This sensor S is formed of a soft elastic body. A button 71 is provided so that a part of the button sticks out of from the surface of a step 2, and a carbon contact 72 is located at back side of the button 71. A contact part 73 mounted on a circuit board 74 is located below the button 71. As shown in FIG. 8(*b*), the contact part 73 includes a pair of circuit patterns 73*a*, 73*b* each of which is in the shape of a comb.

When a user puts the user's feet on the steps 2, the button 71 is pressed and deflected. The circuit patterns 73*a*, 73*b* in the contact part 73 are set by the carbon contact 72 so that the circuit patterns 73*a*, 73*b* are turned on. Thereby, the user's foot is detected.

The invention claimed is:

1. Exercise aiding apparatus, comprising:

a step that a user puts a user's foot on;

a step drive means configured to cause the step to perform movement including turning motion so that exercise is performed with respect to the foot put on the step; and a lock means configured to fix the step by engagement with the step except when the step drive means drives the step.

2. The exercise aiding apparatus of claim 1, comprising a sensor configured to detect whether or not the foot is put on the step, wherein the lock means does not unlock the step when the sensor does not detect the foot.

3. The exercise aiding apparatus of claim 1, wherein the lock means fixes the step to keep the top face of the step horizontal.

* * * * *